United States Patent [19]

Hiramatsu et al.

[11] Patent Number: 4,843,984

[45] Date of Patent: Jul. 4, 1989

[54] APPARATUS FOR SETTING A WORKPIECE ON A ZIPPER SEWING MACHINE

[75] Inventors: Tooru Hiramatsu, Fuchu; Shigeru Tobita, Chofu, both of Japan

[73] Assignee: Juki Corporation, Chofu, Japan

[21] Appl. No.: 238,628

[22] Filed: Aug. 30, 1988

[30] Foreign Application Priority Data

Aug. 31, 1987 [JP] Japan ..... 62-218694

[51] Int. Cl.[4] ..... D05B 3/12

[52] U.S. Cl. ..... 112/114; 112/121.12; 112/265.2

[58] Field of Search ..... 112/114, 104, 70, 76, 112/121.27, 121.26, 265.2, 148, 121.12

[56] References Cited

U.S. PATENT DOCUMENTS 3,919,942 11/1975 Galya et al. ..... 112/166
4,416,208 11/1983 Nufer ..... 112/240
4,497,270 2/1985 Boser ..... 112/104 X
4,648,335 3/1987 Hiramatsu et al. ..... 112/114

FOREIGN PATENT DOCUMENTS 0020010 7/1970 Japan ..... 112/265.2
0046341 11/1980 Japan ..... 112/104
0199893 9/1986 Japan ..... 112/104
0226091 10/1986 Japan ..... 112/104
0079092 4/1987 Japan ..... 112/121.12

*Primary Examiner*—Peter Nerbun
*Attorney, Agent, or Firm*—Morgan & Finnegan

[57] ABSTRACT

An alignment apparatus for setting a workpiece on a zipper sewing machine including a workpiece presser arm having surface projections which contact with internal micro-switches of a ring-like side plate which receives and faces the workpiece presser unit. The presence or absence of the surface projections in relation to the micro-switches creates variations in signals which are effective to select the required sewing pattern.

13 Claims, 15 Drawing Sheets

APPARATUS FOR SETTING A WORKPIECE ON A ZIPPER SEWING MACHINE

BACKGROUND OF THE INVENTION

This invention relates to an apparatus for setting a workpiece correctly on a zipper sewing machine and more particularly to an apparatus providing presser-guide-plates to control the required sewing pattern for a zipper sewing machine.

Zipper sewing is very difficult since the positional relation between the workpiece and the zipper must be precisely set-up. For example, sewing a zipper to a skirt requires a high degree of skill since the zipper must be sewed to the biased or waistline curved portion of skirt.

FIGS. 15, 16 and 17 refer to a conventional type of zipper-skirt sewing machine. In the conventional zipper-skirt sewing machine, in order to sew a zipper F (FIG. 15) to a front cloth C1 (FIG. 16) of a skirt, a cassette 3 must first be placed on a set-table 1. The upper frame 3*a* of the casset 3 is opened upward. A lining cloth C2, with a zipper F previously sewed thereto, is then placed on a lower frame 3*b*, and the zipper F is aligned with a zipper guide 1*a* such that the zipper F is correctly situated. Further, the front cloth C1 is placed on the lining cloth C2 such that the to-be-sewed portions C1*a*, C1*b* are positioned on the set-table 1.

After the cloth has been positioned as indicated above, the operator must go through the following time-consuming steps:

(1) the operator steps on a pedal switch P1 activating a cylinder 4 to cause a right presser arm 7 to turn down;

(2) the end of the to-be-sewed portion C1*a* is set along a right pressure plate 7*a* such that the inner corner of presser plate 7*a* abuts against the end of the to-be-sewed portion C1*a* as shown in FIG. 17A;

(3) the operator steps on a pedal switch P1 activating a cylinder 5 to cause a left presser plate 8*a* to turn down;

(4) the to-be-sewed portion C1*a* will be set firmly on the set-table 1 as shown in FIG. 17B;

(5) the operator again steps on the pedal switch P1 releasing the cylinder 4 to cause the presser arm 7 to turn up as shown in FIG. 17C;

(6) the end of a to-be-sewed portion C1*b* is set along a left presser plate 8*a* such that the inner corner of presser plate 8*a* abuts against the end of the to-be-sewed portion C1*b* as shown in FIG. 17D;

(7) the operator steps on the pedal switch P1 to turn down the right presser plate 7*a* as shown in FIG. 17E;

(8) the upper frame 3*a* turns down and the periphery portion of the to-be-sewed portion is clamped between the upper frame 3*a* and the lower frame 3*b*, as shown in FIG. 17F;

(9) spring bodies 3C (FIG. 16) located at both sides of presser arm 7, 8 engage with stopper notches $N_1$, $N_2$ respectively such that the workpiece will be kept clamped between the upper frame 3*a* and the lower frame 3*b;*

(10) the operator next steps on the pedal switch P1 to turn up the presser plates 7, 8 respectively as shown in FIG. 17G, and takes out the cassette 3 with the workpiece C clamped therein, and sets on the zipper sewing machine and conducts zipper sewing to the workpiece C;

(11) a pedal switch P2 is used to step back the action executed by P1 switch when the operator desires to adjust above setting actions; and

(12) as previously mentioned, the to-be-sewed portions C1*a*, C1*b* are abutted against the corner edge of the presser arms 7, 8 respectively. Thereby, the setting of the workpiece C was much improved when compared with the former manner of judging by the human eye, and as a result, the productivity was highly increased.

SUMMARY OF THE INVENTION

However, in operations where many kinds of workpieces flow on a production line, zippers often need to be changed to match the workpieces and this often requires changing the sewing patterns. In such cases, the operator has to input the zipper sewing pattern, typically from a keyboard, for each varying workpiece. As a result, keypunch errors can occur and mis-stitchings and needle-damages frequently result.

It is therefore an object of the invention to provide an improved alignment apparatus for setting a zipper on a workpiece.

It is a further object of the invention for providing a zipper setting apparatus which is readily adaptable to a variety of zippers.

These and other objects are met by providing an alignment system according to the invention for setting a workpiece on a zipper sewing machine. The present invention allows the presser arms 7, 8 to be changed to match the selected zipper. In contrast, the conventional type workpiece setting apparatus comprises the presser arms 7, 8, air cylinders 4, 5, and a support body 9 and these parts are connected firmly together. Thus, the changing of the presser arms 7, 8 in the conventional system requires much more time and labor in addition to requiring specialized tools.

The present invention allows the operator to input the correct sewing patterns automatically whenever the presser arms 7, 8 are changed to match the various types of zippers passing by on the production line. Thus, key punch errors often experienced in the conventional type of zipper sewing machines are eliminated. Moreover, the invention enables the operator to exchange presser arms 7, 8 quickly when the sewing pattern is to be changed.

In a preferred embodiment, presser arms 7, 8 are designed to be rotatable and easily detachable from the machine by rotating a tightening knob. Controls for the zipper sewing pattern are provided at the presser arms 7, 8 so when these presser arms are set, the presser arms 7, 8 input necessary instructions automatically to the control unit. Another embodiment of the present invention includes a detecting means to detect these instructions at the sewing machine. The detecting means also transfers the necessary selected information to the control unit.

BRIEF DESCRIPTION OF THE DRAWINGS

The invention will be described in greater detail below by way of reference to the following drawings, wherein.

Figure 1:
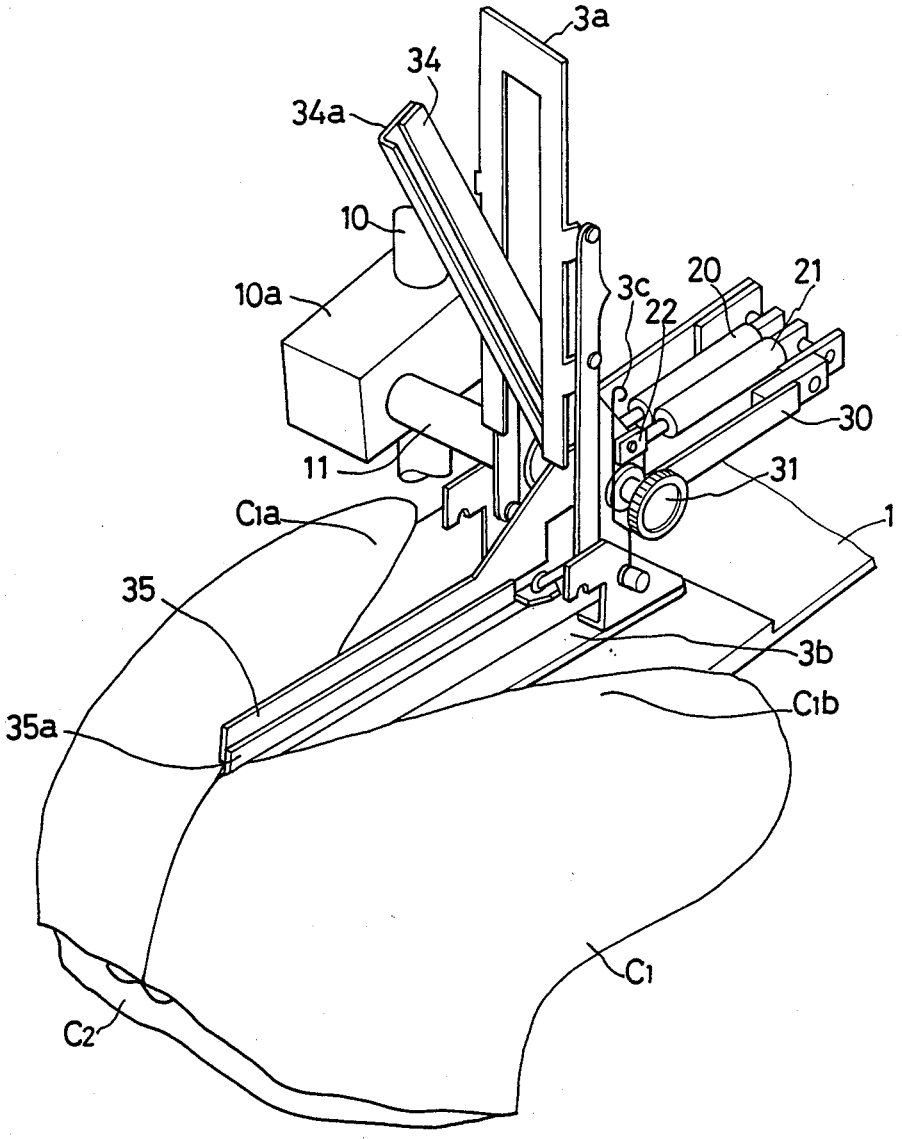
FIG. 1 is a perspective view of an apparatus for setting a workpiece on a zipper sewing machine according to a preferred embodiment of the present invention.
Figure 2:
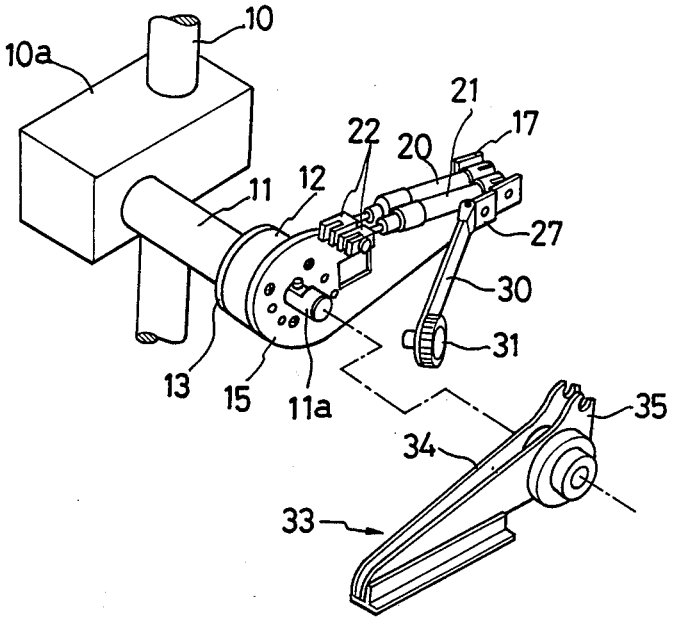
FIG. 2 is an exploded perspective view of a portion of FIG. 1.

key-board 46 which inputs data; pedal switch inputs 47, 48 related with the pedal switch relays P1, P2; an air cylinder drive circuit 49 which activates the air cylinders 20, 21 and is controlled by the CPU 43; and a pulse motor 50 which moves the set-table and is controlled by the CPU 43.

Figure 3:
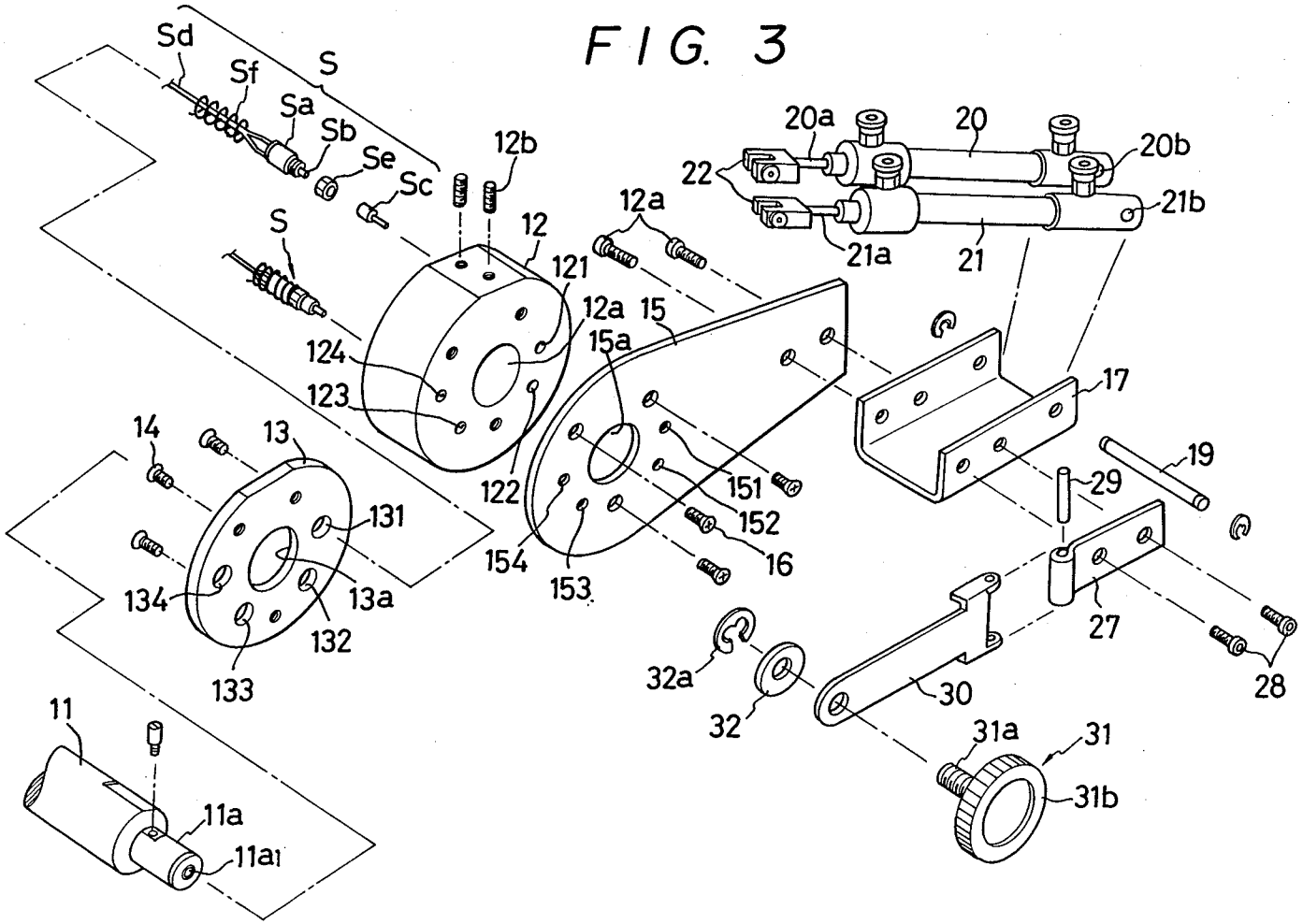
FIG. 3 is a further exploded view of FIG. 2.
Figure 4:
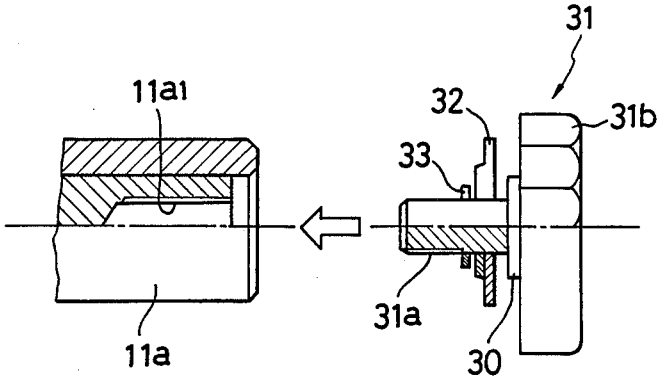
Figure 5:
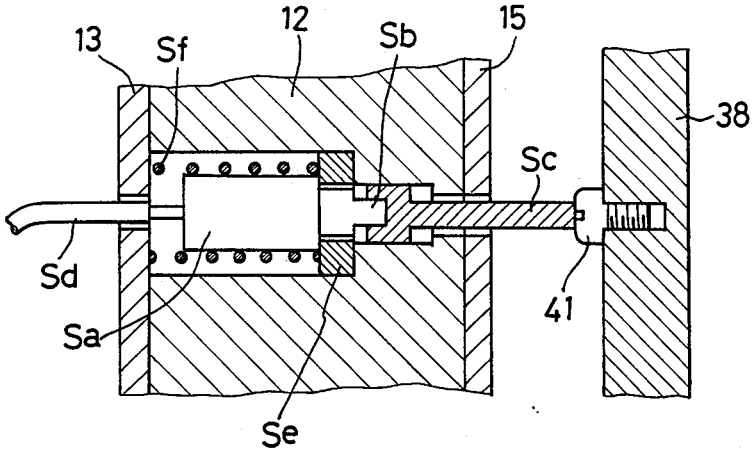
Figure 6:
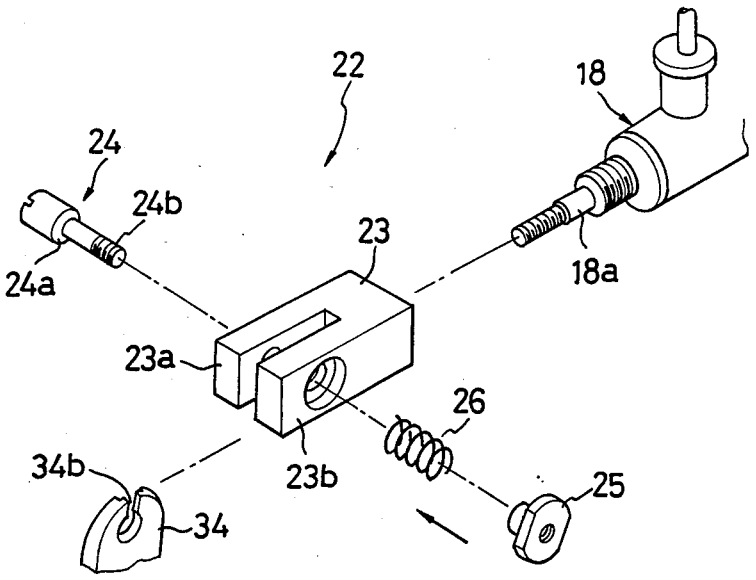
Figure 11:
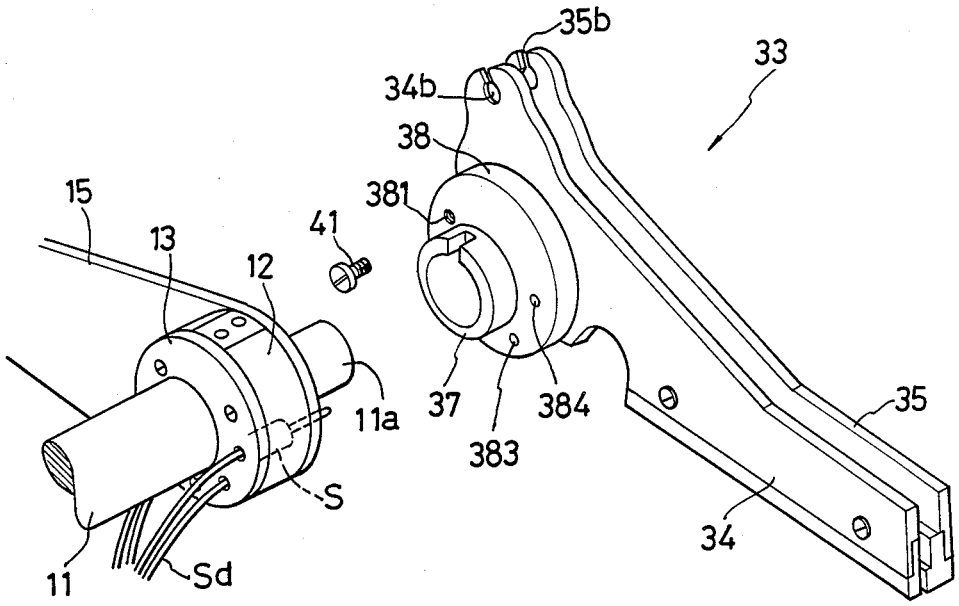
Figure 12:
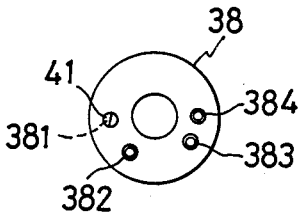
Figure 13:
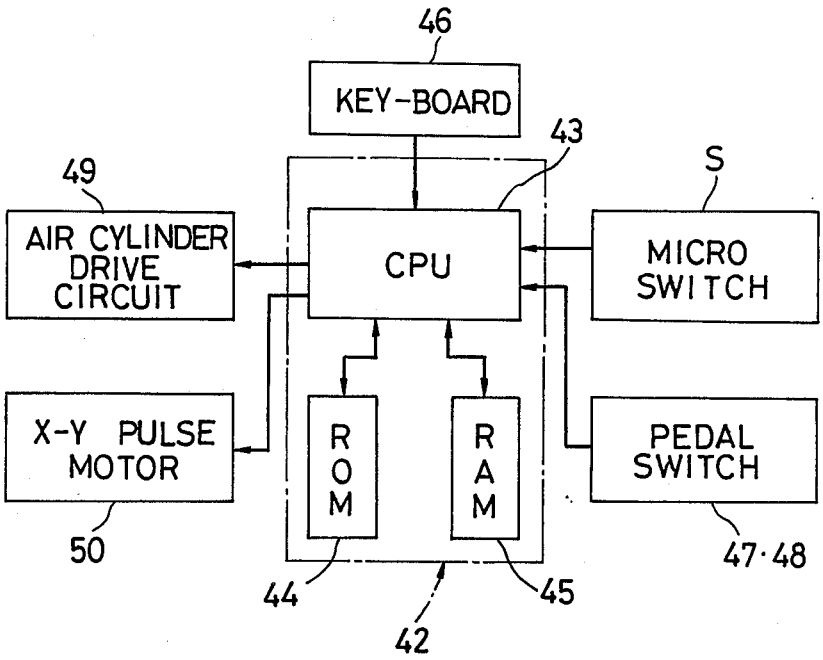
Figure 14A:
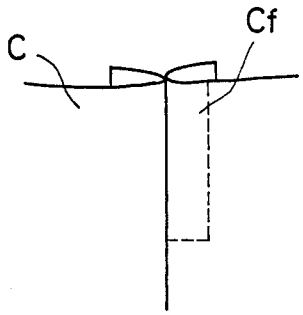
Figure 14B:
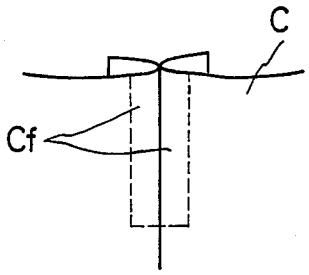
Figure 14C:
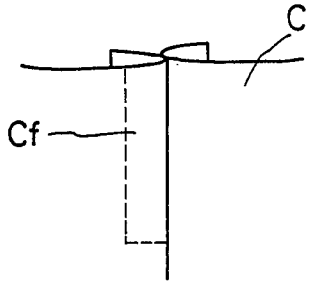
Figure 15:
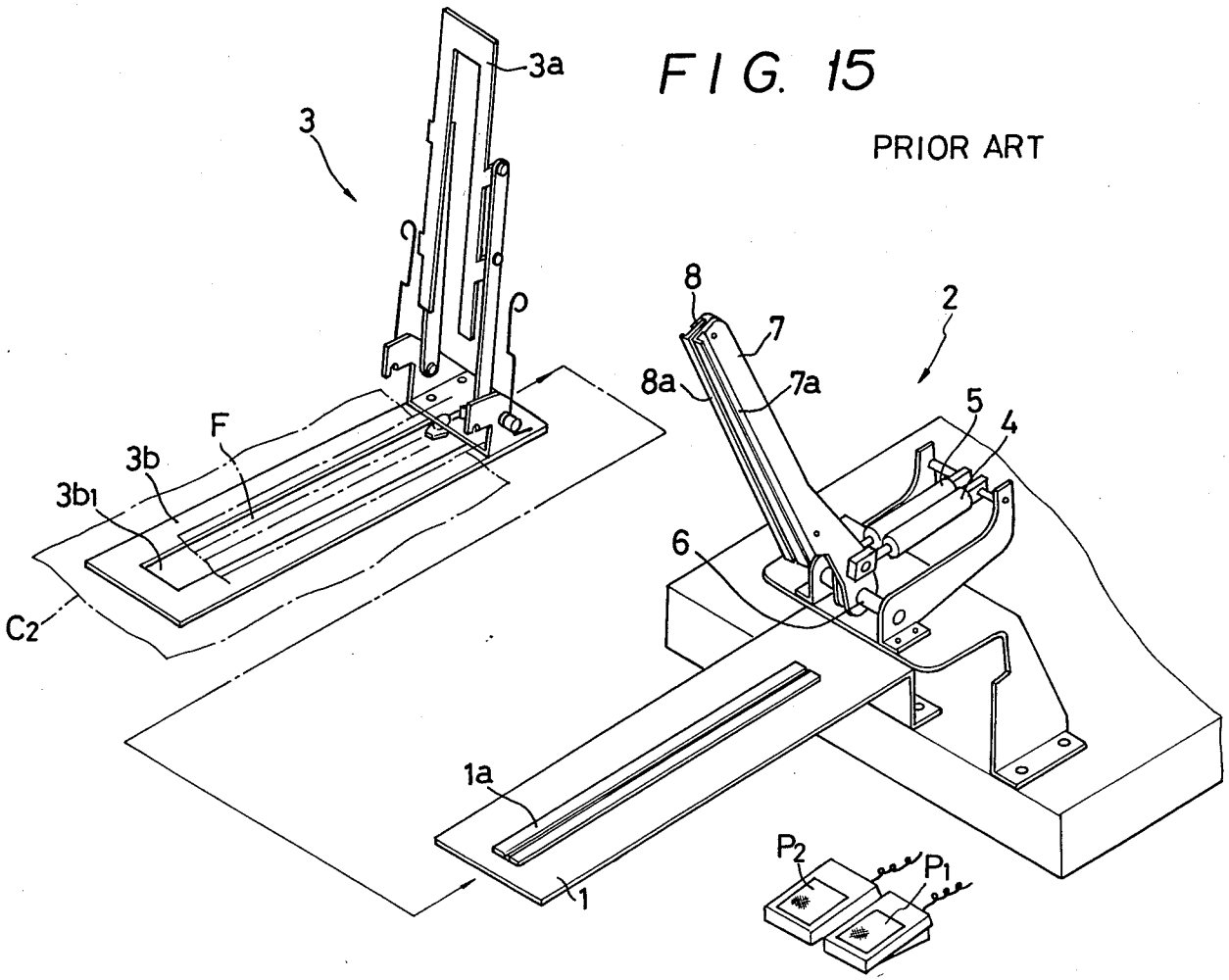
FIG. 15 PRIOR ART
Figure 16:
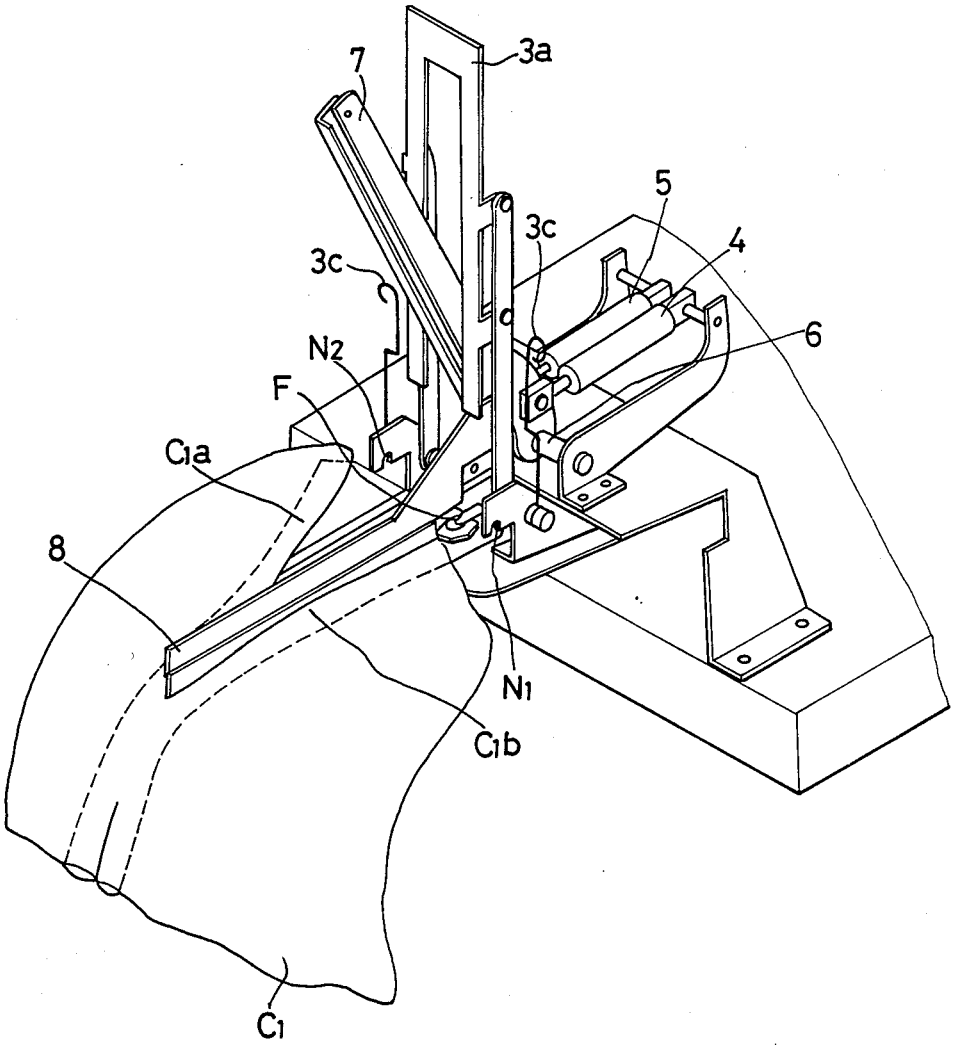
FIG. 16 PRIOR ART
Figure 17A:
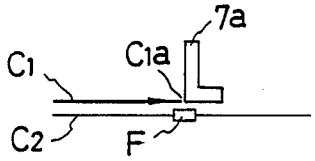
Figure 17B:
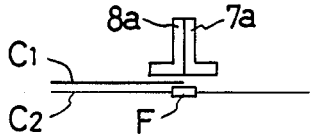
Figure 17C:
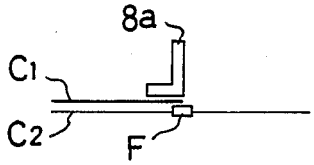
Figure 17D:
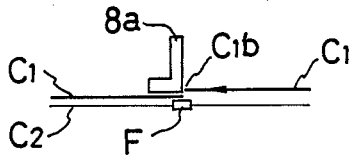
Figure 17E:
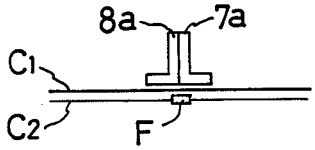
Figure 17F:
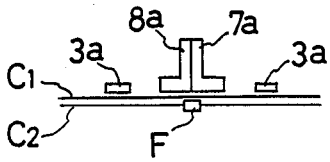
Figure 17G:
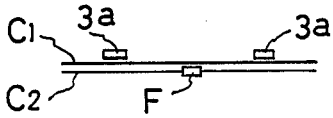

The first step in the operation of the control system involves the selection the required workpiece presser 33. The shaft 37 of the selected workpiece presser 33 fits on the engager 11*a* as shown in FIG. 11. Referring to FIG. 3 and FIG. 1 the door plate 30 is closed, and then the screw 31*a* of the tightening knob 31 is fitted into the female screw 11*a*$_1$ of the engaging body as shown in FIG. 4, such that the workpiece presser 33 is firmly clamped between the support plate 15 and the door plate 30. Since the workpiece presser 33 provides proper presser arms 34, 35 with suitable presser plates 34*a*, 35*a* respectively, and presser plates 34*a* 35*a* are positioned to meet with the workpiece to be sewed, the operator does not need to make any more adjustments.

Figure 7:
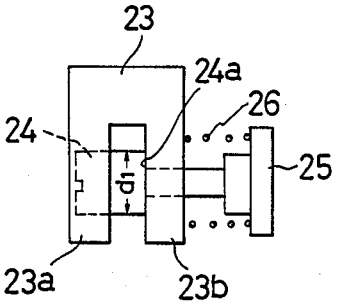
Figure 8A:
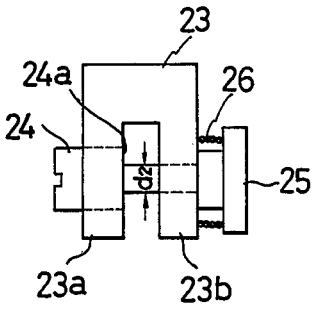

Referring to FIG. 7 and FIG. 8A, the presser button 25 is pressed against the spring 26 such that the knuckle shaft 24 is moved leftward and the small diameter $d_2$ of the knuckle shaft 24 is exposed as shown in FIG. 8A.

Figure 8B:
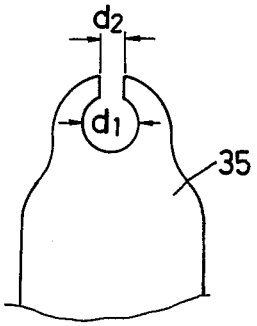
Figure 9:
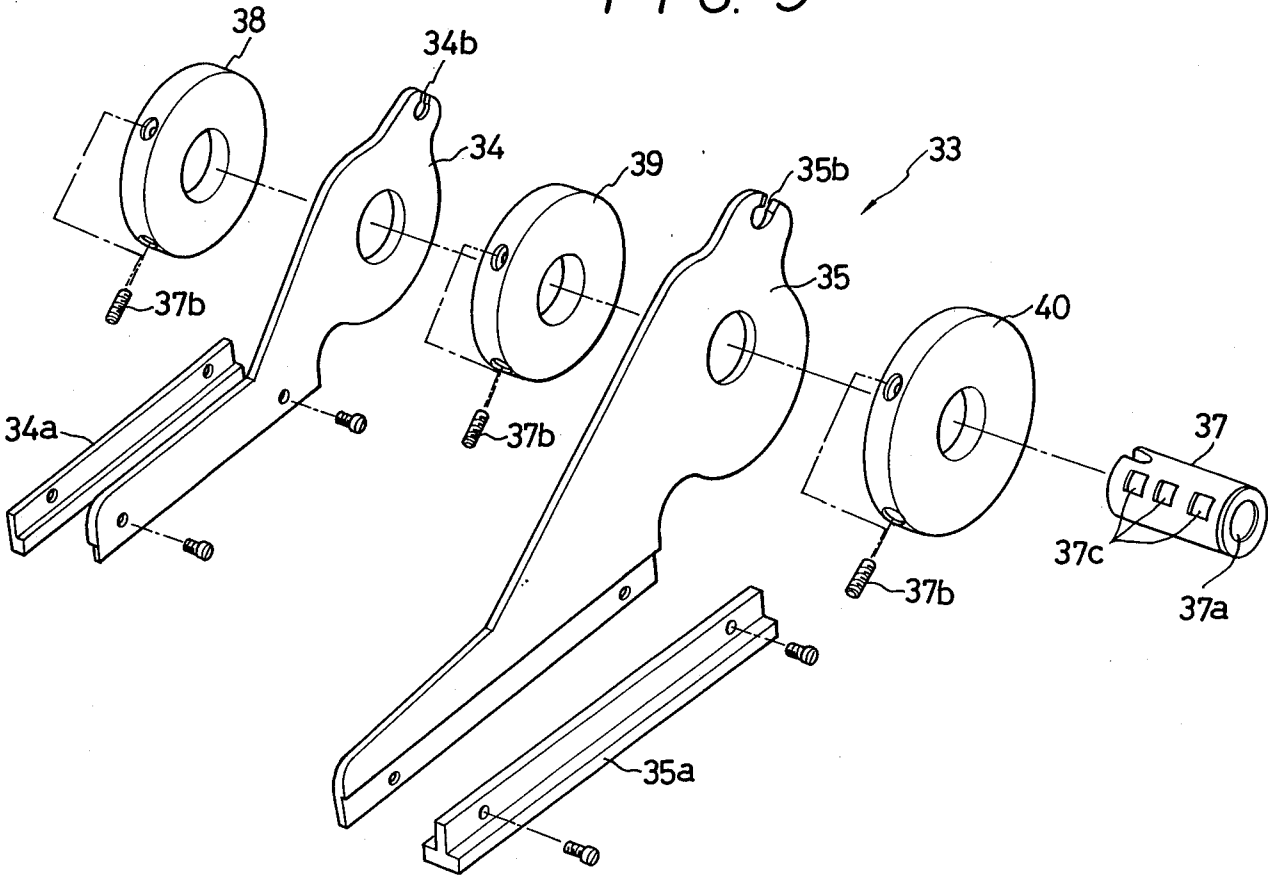
Figure 10:
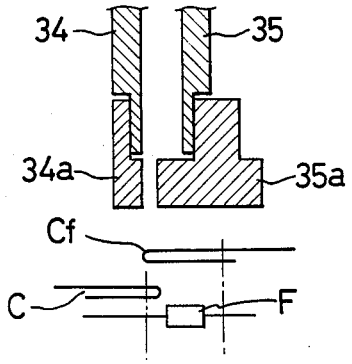
Figure 10:
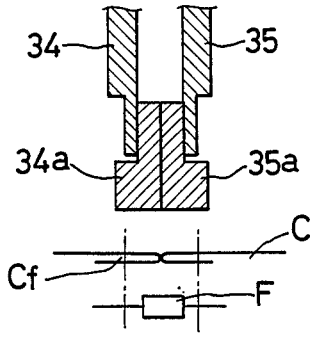
Figure 10:
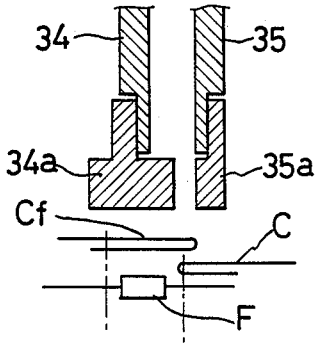

Further with regard to FIG. 8B, the arm 35 provides an inlet notch with dimension $d_2$ and an inner notch with diameter $d_1$, such that the knuckle shaft 24 is inserted through the $d_2$-dimension portion of the knuckle shaft 24. After inserting, the presser button 25 is released such that the knuckle shaft 24 moves rightward and the $d_1$ portion inserts into the inner notch with the $d_1$ dimension and thus the arm 35 is connected to the air cylinder 21. The same operation is repeated for the arm 34, and the arm 34 is connected to the air cylinder 20, and thus all settings are completed for sewing.

As previously mentioned, the detect screw 41 is pushing one of four micro-switches. The relayed micro-switch S sends a signal to the CPU 43. The CPU 43 reads the sewing pattern from the ROM 44 and thus the machine is ready to sew.

The setting of the workpiece is conducted by the lifting and lowering of the presser arms 34, 35 using the pedal switches $P_1$, $P_2$. The cassette 3 clamps the workpiece as desired on the sewing portion of the sewing machine.

Upon inputting the start signal, the CPU 43 commands an X-Y pulse motor 50 to move in accordance with the selected sewing pattern. When the sewing pattern is to be changed, the presser buttons 25 are pressed and the presser plates 34, 35 are separated from the knuckle shafts 24 and are disconnected from the air cylinders 20, 21 respectively. The tightening knob 31*b* is released and the screw 31*a* disengages from the engage body 11*a* and the door plate 30 is opened and the workpiece presser unit 33 is taken out.

When a newly selected workpiece presser unit 33 is installed, the newly positioned detect screw 41 pushes another micro-switch. The number of detect screws is not limited to one. As previously mentioned, a detect screw 41 having a yes or no option in each of the four screw holes allows for a total of sixteen ($2^4=16$) different settings for the workpiece presser unit 33. In the preferred embodiment, the detect screw 41 is used to press the micro-switch, however other detecting means are possible. For example, in lieu of the detect screw 41, a photo projector may be substituted, and in lieu of the micro-switch S, a photo switch is may be substituted. In another example, in lieu of the detect screw 41 a magnetic element may be substituted, and in lieu of the micro-switch S, a magnetically-sensed-lead switch may be substituted.

In the disclosed embodiments, four micro-switches S and four detect screws 41 are used, but these numbers are not limited to four, and other numbers of switches and detect screws are applicable depending on the needs.

As previously mentioned, inputting of the correct sewing pattern is easily conducted whenever the selected workpiece is installed and the method of changing patterns can also be done very quickly.

It will thus be understood that, although the invention has been described in detail above with reference to the preferred embodiments, the invention is not limited to the 7 disclosed embodiments but should be interpreted in accordance with the claims which follow.

What is claimed is:

1. An apparatus for setting a workpiece on a zipper sewing machine, comprising:

(a) a cassette, having a lower frame and an upper frame adapted to open and close against said lower frame;

(b) a set-table to set said cassette detachably;

(c) a workpiece presser unit having a pair of rotatable presser arms adapted to comply with the stitching formation of said workpiece;

(d) an arm body for supporting said presser unit to be positioned within an inner area of said lower frame by rotating;

(e) driving means for individually rotating said pair of rotatable presser arms;

(f) said arm body having an arm in which said rotatable presser arms are detachably inserted;

(g) a tightening knob for fixing said presser unit to said arm body to position said rotatable presser arms; and (h) said driving means having an engageable portion which detachably engages with said rotatable presser arms.

2. An apparatus for setting a workpiece on a zipper sewing machine, comprising:

(a) a cassette having a lower frame, and an upper frame adapted to open and close against said lower frame;

(b) a set-table to detachably set said cassette;

(c) a workpiece presser unit having a pair of rotatable presser arms to position the workpiece on said set-table;

(d) an arm body which detachably supports said workpiece presser unit such that said pair of rotatable presser arms descends inside of said lower frame;

(e) a tightening body which fixes said workpiece presser unit to said arm body;

(f) driving means which provides an engageable body with said pair of rotatable presser arms and drives said pair of rotatable presser arms to open and close;

(g) a to-be-detected part, located at said workpiece presser unit, for presenting sewing pattern information corresponding to said installed workpiece presser unit; and (h) detecting means for detecting said to-be-detected part.

3. An apparatus for setting a workpiece on a zipper sewing machine as recited in claim 2, wherein said workpiece presser unit provides multiple predetermined positions corresponding to said to-be-detected parts such that said detecting means detect presence of said to-be-detected part.

4. An apparatus for setting a workpiece on a zipper sewing machine as recited in claim 2, wherein said detecting means is a micro-switch which relays a push at said to-be-detected part which is located at said workpiece presser unit.

5. An apparatus for setting a workpiece on a zipper sewing machine as recited in claim 3, wherein said detecting means is a micro-switch which relays a push at said to-be-detected part which is located at said workpiece presser unit.

6. An apparatus for setting a workpiece on a zipper sewing machine as recited in claim 2, wherein said detecting means comprises a photo projector located at the multiple predetermined positions of said workpiece presser unit and a photo switch which relays by receiving light from said photo projector.

7. An apparatus for setting a workpiece on a zipper sewing machine, as recited in claim 3, wherein said detecting means comprises a photo projector located at the multiple predetermined positions of said workpiece presser unit and a photo switch which relays by receiving light from said photo projector.

8. An apparatus for setting a workpiece on a zipper sewing machine as recited in claim 2, wherein said detecting means comprises a magnetically operated element and said to-be-detected part comprises a magnetized element.

9. An apparatus for setting a workpiece on a zipper sewing machine, as recited in claim 3, wherein said detecting means comprises a magnetically operated element and said to-be-detected part comprises a magnetized element.

10. An apparatus for setting a workpiece on a zipper sewing machine, as recited in claim 1, wherein said driving means comprises a pair of air cylinders.

11. An apparatus for setting a workpiece on a zipper sewing machine, as recited in claim 2, wherein said driving means comprises a pair of air cylinders.

12. An apparatus for setting a workpiece on a zipper sewing machine, as recited in claim 1, wherein said driving means comprises a pair of solenoid operated arms.

13. An apparatus for setting a workpiece on a zipper sewing machine, as recited in claim 2, wherein said driving means comprises a pair of solenoid operated arms.

* * * * *